United States Patent [19]

Lutz

[11] Patent Number: 4,632,491

[45] Date of Patent: Dec. 30, 1986

[54] WIRE RETAINING ASSEMBLY

[75] Inventor: David L. Lutz, North Branford, Conn.

[73] Assignee: Harvey Hubbell Incorporated, Orange, Conn.

[21] Appl. No.: 759,495

[22] Filed: Jul. 26, 1985

Related U.S. Application Data

[63] Continuation of Ser. No. 485,317, Apr. 15, 1983, abandoned.

[51] Int. Cl.[4] ..... H01R 13/50

[52] U.S. Cl. ..... 339/164 M; 339/269; 339/271; 339/105

[58] Field of Search ..... 339/263, 269, 271, 103 R, 339/103 M, 164 M, 105, 106, 163

[56] References Cited

U.S. PATENT DOCUMENTS

| | | | |
|---|---|---|---|
| 2,694,800 | 11/1954 | Sunderhauf | 339/269 |
| 2,735,080 | 2/1956 | Littman | 339/269 |
| 3,423,724 | 1/1969 | Clement | 339/269 |
| 3,861,773 | 1/1975 | Triantafellow et al. | 339/103 R |
| 4,060,305 | 11/1977 | Poliak et al. | 339/269 |
| 4,325,599 | 4/1982 | Feldman | 339/103 R |

FOREIGN PATENT DOCUMENTS

| | | | |
|---|---|---|---|
| 548206 | 9/1956 | Italy | 339/269 |
| 673907 | 6/1952 | United Kingdom | 339/269 |

*Primary Examiner*—Gil Weidenfeld
*Assistant Examiner*—David L. Pirlot
*Attorney, Agent, or Firm*—Jerry M. Presson; Alfred N. Goodman

[57] ABSTRACT

A wire retaining assembly for use with an electrical device such as a switch or receptacle. The assembly comprises an anchoring bore and a guide slot formed in a wall adjacent each terminal screw to retain the exposed wire on an electrical conductor. By initially locating the end of the exposed wire in the anchoring bore, then bending the wire around the screw shank and locating the other end of the wire in the guide slot, electrical connection to the device is more quickly and securely accomplished. The bore and slot are substantially parallel and have portions with substantially coplanar bottom surfaces so that the bent wire lies in substantially a single plane.

25 Claims, 9 Drawing Figures

WIRE RETAINING ASSEMBLY

This is a continuation of application Ser. No. 485,317 filed Apr. 15, 1983, now abandoned.

FIELD OF THE INVENTION

The invention relates to an electrical device, such as a switch or receptacle, having an anchoring bore and a guide slot formed in a wall adjacent each terminal screw to retain the exposed wire on an electrical conductor which is bent around the screw.

BACKGROUND OF THE INVENTION

Making an electrical connection between the exposed wire on an electrical conductor and a terminal screw located on the side of an electrical device, such as a switch or receptacle, is intricate and difficult because the screws are small and the end of the wire must be bent closely around the shank of the screw. Accordingly, this operation is time consuming and potentially frustrating. Moreover, it is quite important to make a good connection in order to prevent short circuits or other electrical hazards.

Various prior art devices have been directed towards facilitating such a wire connection; however, they have not been totally successful. This is because some of the prior art devices tend to bend the exposed wire in more than one plane, which can weaken or break the wire and tends to prevent a secure electrical connection. In addition, some of these devices require prebending of the exposed wire, which is difficult and time consuming in and of itself, or do not securely receive the end of the exposed wire so it is free to move transversely of its longitudinal axis, thereby making the connection more time consuming. Some of these devices also require stripping a precise length of the insulation from the conductor, which is time consuming and dangerous if done inaccurately.

One example of these devices includes a pocket and a slot formed in an electrical device having a terminal plate located in a recess. A rear wall partially spans the rear edge of the terminal plate and the end of this wall together with a lower wall extending along the lower edge of the terminal plate define the slot, which is outwardly opening and has a rectangular cross section. The rear wall and an upper wall extending along the upper edge of the terminal plate define a 90° corner with a triangular fillet therein at the bottom and a larger triangular web above the fillet to form the pocket. The pocket receives an end of the wire and the slot receives another part of the conductor after the exposed wire is bent around the terminal screw. This device allows transverse movement of the end of the wire which makes the connection difficult and time consuming.

Other examples of such prior art devices are disclosed in the following U.S. Pat. Nos.: 2,735,080 to Littman; 3,423,724 to Clement; and 3,861,773 to Triantafellow et al.

Thus, there is a continuing need for improvement in an assembly for facilitating electrical wire connection to an electrical device.

SUMMARY OF THE INVENTION

Accordingly, a primary object of the invention is to provide a wire retaining assembly for use with an electrical device, such as a switch or receptacle, that can facilitate a quick and secure connection between the wire and the device.

Another object of the invention is to provide such a wire retaining assembly that is easy to manufacture and use.

Another object of the invention is to provide such a wire retaining assembly that retains the exposed wire in substantially a single plane to assure good connection.

The foregoing objects are basically attained by providing in an electrical device having a front, a rear, a right side and a left side; a substantially planar portion on one of the sides having a threaded bore perpendicular thereto; and a screw having a threaded shank adapted to be threaded into the threaded bore substantially perpendicularly to the planar portion for electrical connection to a conductor having an exposed wire, the improvement comprising means, extending outwardly from the planar portion, defining an anchoring opening for receiving and surrounding the exposed wire on the conductor to restrict movement of the wire in all directions transverse to its longitudinal axis.

Advantageously, the anchoring opening is formed as a bore in a wall and a guide slot is located adjacent the anchoring bore for receiving another part of the exposed wire on the conductor so that the exposed wire between the anchoring bore and the guide slot is bent around the screw shank in a substantially U-shaped configuration in a single plane.

Other objects, advantages and salient features of the invention will become apparent from the following detailed description which, taken in conjuction with the annexed drawings, discloses preferred embodiments of the invention.

DRAWINGS

Referring now to the drawings which form a part of this original disclosure:

DETAILED DESCRIPTION OF THE INVENTION

Figures 1, 2, 3:
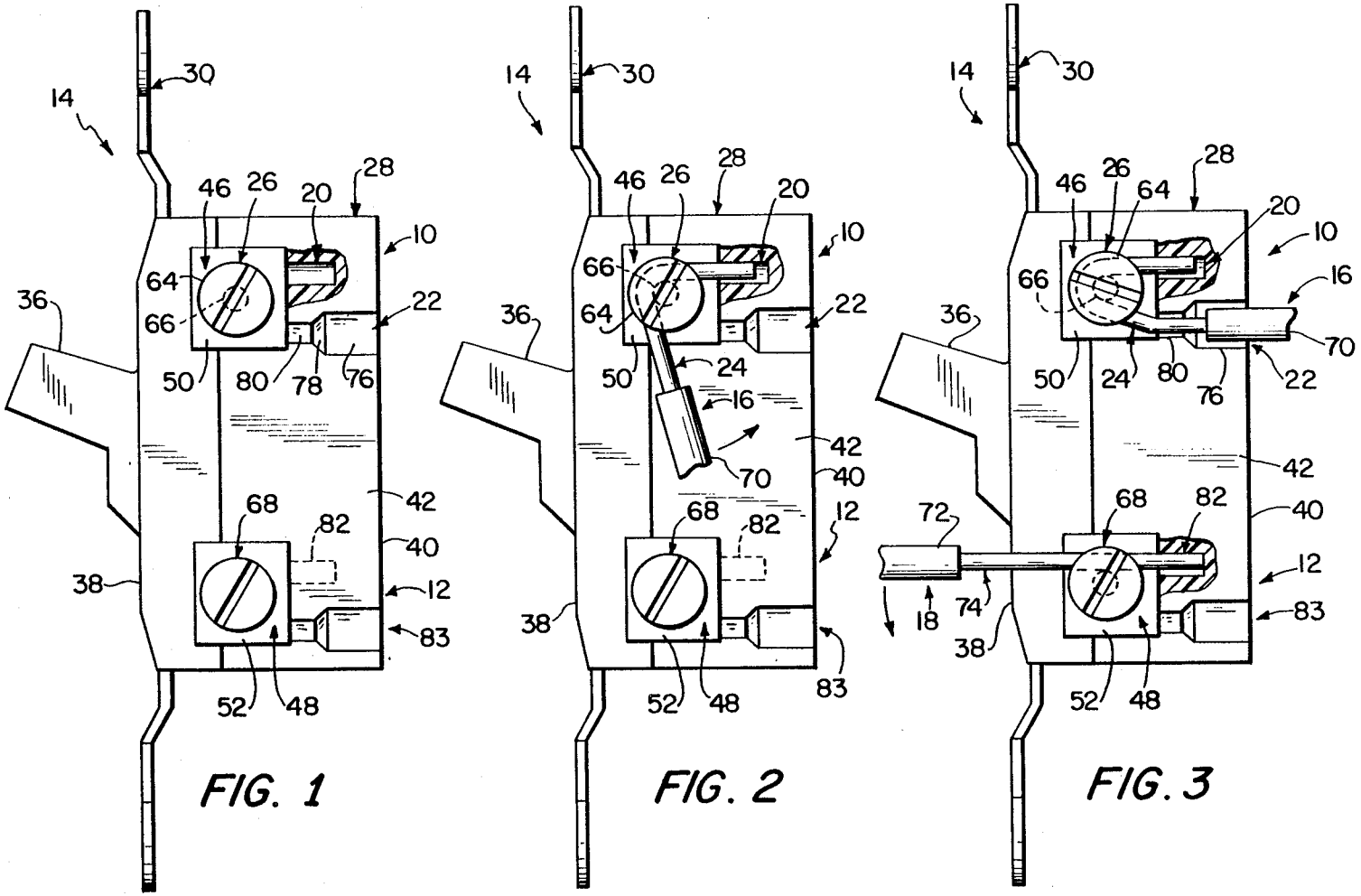
FIG. 1 is a right side elevational view of the wire retaining assembly in accordance with the invention located on an electrical switch.
FIG. 2 is a right side elevational view similar to that shown in FIG. 1 except that the exposed wire on an electrical conductor has been located in the anchoring bore in the wire retaining assembly and partially bent around the shank of a terminal screw.
FIG. 3 is a right side elevational view similar to that shown in FIG. 2 except that the exposed wire has been fully bent around the screw shank and received in a guide slot in the wire retaining assembly, the bottom of FIG. 3 showing the initial step of locating the exposed wire in the anchoring bore.
Figure 4:
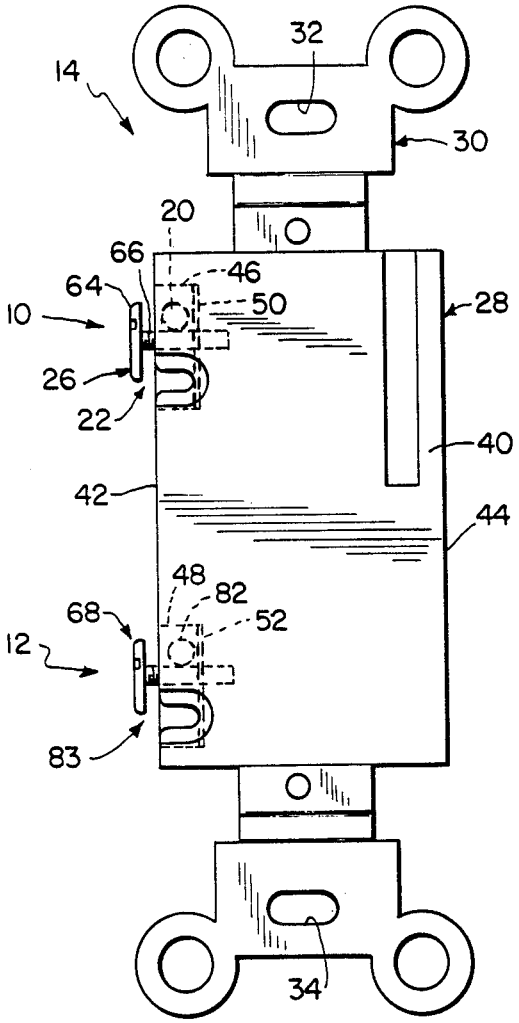
FIG. 4 is a rear elevational view of the electrical switch shown in FIG. 1 with the wire retaining assembly thereon.
Figure 5:
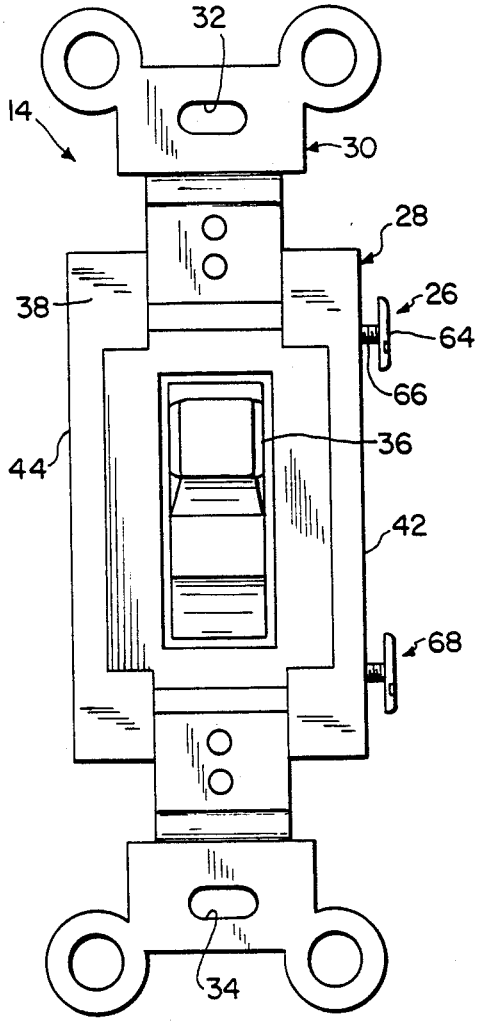
FIG. 5 is a front elevational view of the electrical switch shown in FIGS. 1 and 4.

Referring now to FIGS. 1–6, a pair of wire retaining assemblies 10 and 12 in accordance with the invention are shown located on an electrical device such as switch 14 for use in facilitating connection of electrical conductors 16 and 18 to the switch. As best seen in FIGS. 1–3 and 6, the wire retaining assembly 10 comprises an anchoring bore 20 and a guide slot 22 for receiving the exposed wire 24 extending from the end of the electrical conductor 16.

By initially locating the end of the exposed wire 24 in the anchoring bore 20, then bending the wire around the terminal screw 26 and finally locating the other end of the wire in the guide slot 22, electrical connection to switch 14 is very quickly and securely accomplished, with the substantially U-shaped configuration of the finally bent exposed wire 24 lying in substantially a single plane.

As seen in FIGS. 1–5, the electrical switch 14 comprises a housing 28 formed of insulating material, a metallic conducting bridge 30 having mounting holes 32 and 34 at opposite ends, and a handle 36. The housing 28 is typically formed of a plurality of parts but in all events includes a front 38, a rear 40, a right side 42 and a left side 44.

Formed in the right side 42 are a pair of rectangular recesses 46 and 48, each receiving a flat rectangular metallic terminal plate 50 and 52, respectively. Each plate has an internally threaded bore, only bore 54 being shown for terminal plate 50 in FIG. 6.

Each terminal plate forms a planar portion as the bottom wall of each recess and each of the threaded bores is substantially perpendicular to the planar portion.

Figure 6:
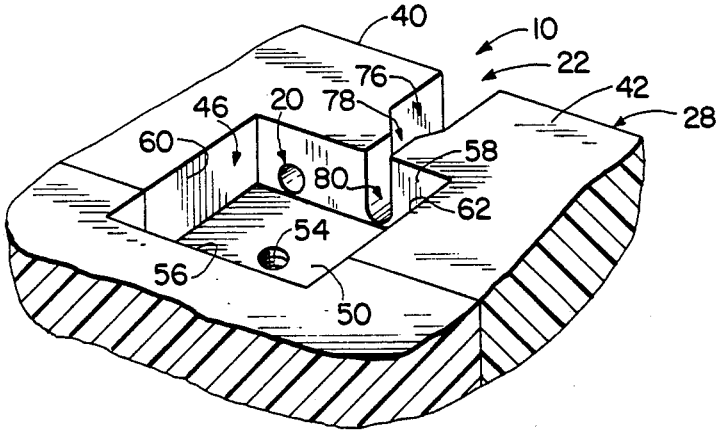
FIG. 6 is an enlarged, fragmentary perspective view of the wire retaining assembly seen in FIG. 1 but without a terminal screw.

As seen in FIG. 6, recess 46 has a front wall 56, a rear wall 58, an upper wall 60 and a lower wall 62, each of these walls being substantially perpendicular to terminal plate 50, rectangular and planar.

As seen in FIGS. 1–4, terminal screw 26 has a slotted head 64 and a threaded shank 66, shank 66 being threadedly engaged with threaded bore 54 in terminal plate 50 in a position perpendicular to the planar portion formed by the planar surface of the terminal plate 50. The second screw 68 shown with regard to the second wire retaining assembly 12 is similarly constructed and positioned.

As seen in FIGS. 2 and 3, the electrical conductor 16 has an insulating outer jacket 70 covering the conducting wire 24, which can be a single wire or stranded wire, except for the exposed end. Similarly, the second electrical conductor 18 has an insulating outer jacket 72 and an exposed wire 74, as seen in FIG. 3.

Referring now to FIG. 6, the wire retaining assembly 10 is shown formed in the rear wall 58 in housing 28, this wall extending outwardly on the right side 42 of the housing from the planar portion or terminal plate 50. The wall is adjacent and extends to the rear 40 of the housing as seen in FIGS. 1–4 and 6.

The anchoring bore or first opening 20 in the wire retaining assembly 10 is formed as a blind, cylindrical bore having a diameter greater than the diameter of the exposed wire 24. The opening of bore 20 faces screw 26, as seen in FIG. 1, and is formed directly in the front facing surface in wall 58. Bore 20 is perpendicular to the front facing surface and extends rearwardly therefrom.

The guide slot or second opening 22 is formed completely through wall 58 and is outwardly opening, being located adjacent the anchoring bore 20 and adjacent the rear 40 of the housing. Guide slot 22 is generally U-shaped in transverse cross section and has, as best seen in FIG. 1, at its bottom a first semi-cylindrical portion 76, a semi-frustoconical portion 78 extending from the first semi-cylindrical portion and a second semi-cylindrical portion 80 extending from the semi-frustoconical portion, the second semi-cylindrical portion having width less than the width of the first semi-cylindrical portion. As seen in FIG. 3, the first semi-cylindrical portion 76 will receive the outer jacket 70 and thus has a width slightly greater than the diameter of that jacket and the second semi-cylindrical portion 80 will receive the exposed wire 24 and thus has a width greater than the diameter of the wire.

As seen in FIG. 6, the second semi-cylindrical portion 80 of the slot opens through the face of wall 58 and extends towards the rear 40 of the housing, the first semi-cylindrical portion 76 continuing to that rear 40.

As seen in FIG. 6, the bottom surfaces of anchoring bore 20 and the second semi-cylindrical portion 80 are substantially co-planar in a plane that is parallel and substantially co-planar with the plane containing the top of the terminal plate 50. In addition, the longitudinal axes of bore 20 and slot 22 are substantially parallel, receive the screw shank 66 therebetween, and are perpendicular to the threaded bore 54 as well as the screw shank 66 as seen in FIGS. 2 and 3.

The second wire retaining assembly 12 includes an anchoring bore 82 and a guide slot 83 similar to bore 20 and slot 22.

INSTALLATION OF THE ELECTRICAL CONDUCTOR

Referring now to FIG. 3, the first step in installing an electrical conductor on the electrical switch 14 is best illustrated at the bottom of FIG. 3. There, electrical conductor 18 has the exposed wire 74 received in and surrounded completely by anchoring bore 82 which is similar to anchoring bore 20 discussed above. This is accomplished after the terminal screw 68 is unthreaded sufficiently for passage of the exposed wire 74 into bore 82. As seen in FIG. 3, the exposed wire 74 lies adjacent the shank of screw 68 below the head and extends straight into bore 82, the inner edge of wire 74 following tangentially the outer circular edge of the shank. Since the wire is received in and surrounded by the bore, movement of the wire transverse to its longitudinal axis is restricted facilitating the bending or forming of the wire around the screw shank.

The next step is illustrated in FIG. 2 with regard to the first electrical conductor 16 which has been pivoted counterclockwise relative to shank 66, the exposed end 24 being received in bore 20.

The counterclockwise pivoting continues as the exposed wire 24 is bent around shank 66 and then the exposed wire 24 and jacket 70 are located in guide slot 22.

When the jacket 70 and exposed wire 24 are fully received in slot 22, as seen in FIG. 3, the terminal screw 26 is rotated downwardly to bind the exposed wire 24 between the head 64 of the screw and the terminal plate 50, thereby providing a secure electrical connection between the wire 24 and the plate 50. Since the bottom surfaces of anchoring bore 20 and the second semi-cylindrical portion 80 in the slot 22 are in substantially the same plane which is substantially coplanar with the top of plate 50, the U-shaped exposed wire 24 also lies in substantially one plane, which assures a secure electrical connection. In this regard, the plane containing the U-shaped exposed wire is substantially perpendicular to the shank 66 and parallel to the terminal plate 50. As seen in FIG. 3, the exposed wire is bent around the shank less than 360°.

EMBODIMENT OF FIGS. 7–9

Figure 7:
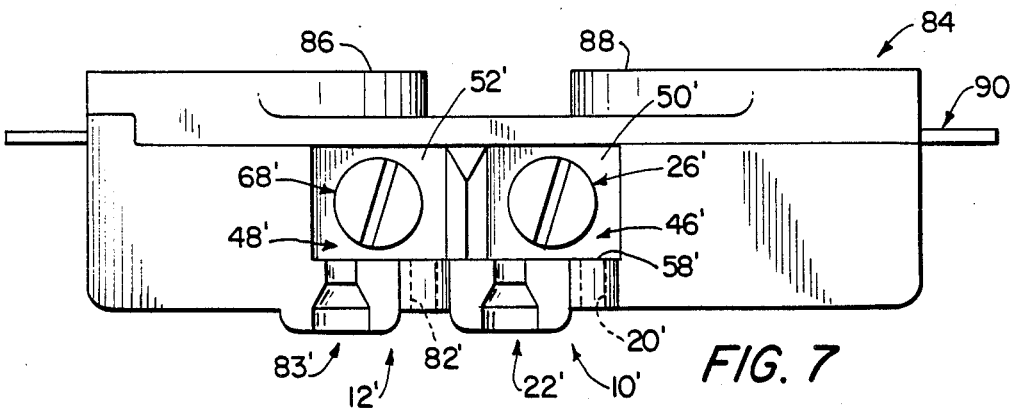
FIG. 7 is a side elevational view of a duplex electrical receptacle having the wire retaining assembly in accordance with the invention thereon.
Figure 8:
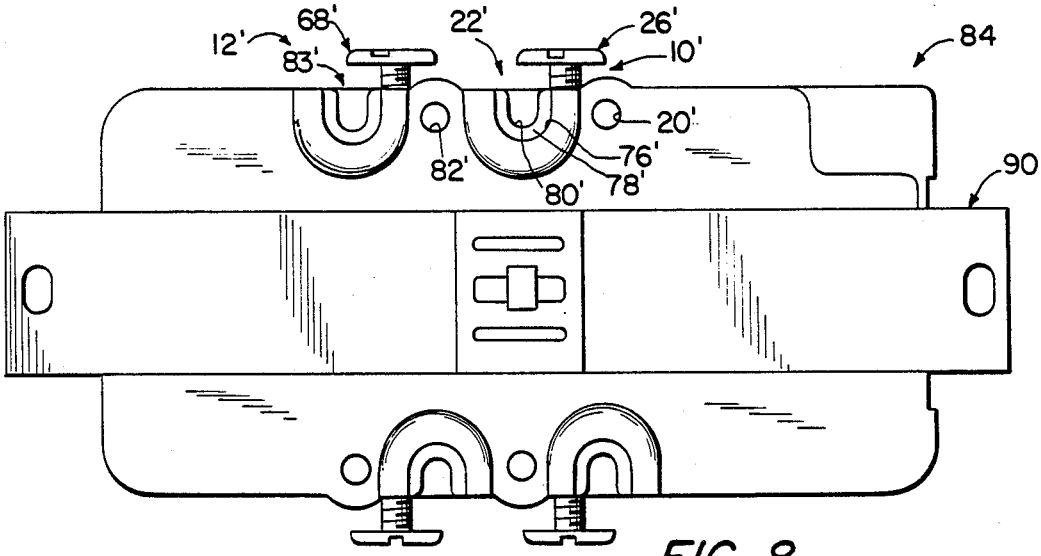
FIG. 8 is a bottom plan view of the receptacle shown in FIG. 7.
Figure 9:
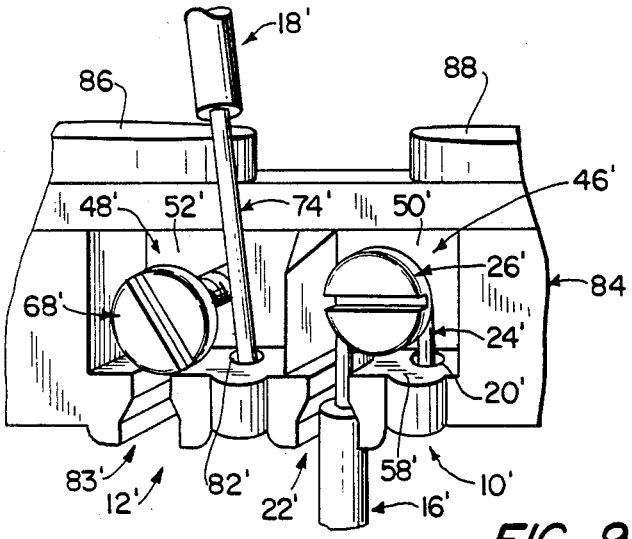
FIG. 9 is an enlarged fragmentary perspective view of a pair of wire retaining assemblies shown in FIG. 7 except with electrical conductors being connected thereto.

As seen in FIGS. 7–9, the wire retaining assembly in accordance with the invention can be utilized with a duplex receptacle 84 having a pair of female connectors 86 and 88.

Receptacle 84 has a bridge 90 and four terminal screws for use with four wire retaining assemblies in accordance with the present invention. Since the basic configuration of the wire retaining assemblies shown in FIGS. 7–9 are the same as those discussed above and shown in FIGS. 1–6, like reference numerals are used with the addition of a prime.

The only basic difference between the wire retaining assemblies shown in FIGS. 7–9 and those shown in FIGS. 1–6 is that the anchoring bores 20' and 82' extend completely through wall 58'.

While various advantageous embodiments have been chosen to illustrate the invention, it will be understood by those skilled in the art that various changes and modifications can be made therein without departing from the scope of the invention as defined in the appended claims.

What is claimed is:

1. In an electrical device having a front, a rear, a right side and a left side; a substantially planar portion on one of the sides having a threaded bore perpendicular thereto; and a screw having a threaded shank adapted to be threaded into the threaded bore substantially perpendicularly to the planar portion and extending outwardly therefrom for electrical connection to a conductor having an exposed wire, the improvement comprising:

means, extending outwardly from said planar portion, defining an anchoring opening for receiving and surrounding the end of the exposed wire on the conductor to restrict movement of the wire in all directions transverse to its longitudinal axis, said anchoring opening comprising a bore having a diameter slightly larger than the diameter of said exposed wire, said bore having a longitudinal portion which is co-planar with said planar portion, said anchoring opening being located above the planar portion and extending outwardly therefrom.

2. The improvement according to claim 1, wherein said means is located adjacent the rear of the electrical device.

3. The improvement according to claim 1, wherein said means comprises a wall having said anchoring opening formed therein.

4. The improvement according to claim 3, wherein said bore is a blind bore.

5. The improvement according to claim 3, wherein said bore extends completely through said wall.

6. The improvement according to claim 1, wherein said bore is cylindrical with a longitudinal axis substantially perpendicular to the longitudinal axis of the threaded bore.

7. The improvement according to claim 6, wherein said means is located adjacent the rear of the electrical device.

8. The improvement according to claim 1, and further comprising guide means, extending outwardly from said planar portion and located adjacent said anchoring opening, for receiving the exposed wire on the conductor.

9. The improvement according to claim 8, wherein said guide means comprises an outwardly opening slot.

10. The improvement according to claim 9, wherein said slot has a longitudinal axis substantially perpendicular to the longitudinal axis of the threaded bore.

11. The improvement according to claim 9, wherein said slot has at its bottom a first semi-cylindrical portion, a semi-frustoconical portion extending from said first semi-cylindrical portion and a second semi-cylindrical portion extending from said semi-frustoconical portion, said second semi-cylindrical portion having a width less than the width of said first semi-cylindrical portion.

12. The improvement according to claim 1, wherein said bore is cylindrical and has a longitudinal axis substantially perpendicular to the longitudinal axis of the threaded bore, and further comprising guide means, extending outwardly from said planar portion and located adjacent said anchoring opening, for receiving the exposed wire on the conductor.

13. The improvement according to claim 12, wherein said guide means comprises a slot having a longitudinal axis substantially perpendicular to the longitudinal axis of the threaded bore.

14. In an electrical device having a front, a rear, a right side and a left side; a substantially planar portion on one of the sides having a threaded bore perpendicular thereto; and a screw having a threaded shank adapted to be threaded into the threaded bore substantially perpendicularly to the planar portion and extending outwardly therefrom for electrical connection to a conductor having an exposed wire, the improvement comprising:

means, extending outwardly from said planar portion, defining a first opening for receiving and surrounding the end of the exposed wire of the conductor to restrict movement of the wire in all directions transverse to its longitudinal axis;

said first opening comprising a bore having a diameter slightly larger than the diameter of said exposed wire, and guide means, extending outwardly from said planar portion, defining a second opening for receiving the exposed wire on the conductor, said first opening and said second opening being substantially parallel to said planar portion, each having a longitudinal portion co-planar with said planar portion, said first opening being located above said planar portion and extending outwardly therefrom, the portion of the exposed wire between said first and second openings being bent around the screw shank.

15. The improvement according to claim 14, wherein said second opening is an outwardly opening slot.

16. The improvement according to claim 14, wherein said first and second openings have longitudinal axes oriented to position the exposed wire in a substantially U-shaped configuration.

17. The improvement according to claim 14, wherein the exposed wire extends around the screw shank through an arc that is less than 360°.

18. The improvement according to claim 14, wherein said first and second openings have longitudinal axes that are substantially parallel.

19. The improvement according to claim 14, wherein the bottom surfaces of at least a portion of said first opening and at least a portion of said second opening lie substantially in a single plane parallel to the planar portion on the electrical device.

20. The improvement according to claim 14, wherein said means and said guide means are located adjacent the rear of the electrical device.

21. The improvement according to claim 14, wherein said first and second openings are oriented to position the bent wire in substantially a single plane perpendicular to the threaded bore.

22. The improvement according to claim 14, wherein said means comprises a wall having said first opening formed therein, said wall having a surface facing the front of the electrical device.

23. The improvement according to claim 22, wherein said first opening extends rearwardly of said wall from said surface.

24. The improvement according to claim 22, wherein said wall surface is substantially planar.

25. The improvement according to claim 24, wherein said wall surface is substantially perpendicular to said planar portion.

* * * * *